US005167410A

United States Patent [19]

Greive et al.

[11] Patent Number: 5,167,410

[45] Date of Patent: Dec. 1, 1992

[54] DEVICE FOR CONVEYING AND ALIGNING SHEETS ON A FEED TABLE OF A PRINTING MACHINE

[75] Inventors: Martin Greive, Heidelberg-Ziegelhausen; Walter d'Heureuse, Ladenburg; Günter Zobl, Nussloch, all of Fed. Rep. of Germany

[73] Assignee: Heidelberger Druckmaschinen AG, Heidelberg, Fed. Rep. of Germany

[21] Appl. No.: 791,053

[22] Filed: Nov. 12, 1991

[30] Foreign Application Priority Data

Nov. 12, 1990 [DE] Fed. Rep. of Germany ..... 4035907
Apr. 16, 1991 [DE] Fed. Rep. of Germany ..... 4112337

[51] Int. Cl.[5] ..... B65H 9/16; B65H 9/04

[52] U.S. Cl. ..... 271/252; 271/253; 271/274

[58] Field of Search ..... 271/234, 248, 250, 251, 271/252, 253, 274

[56] References Cited

U.S. PATENT DOCUMENTS

| | | | |
|---|---|---|---|
| 1,986,253 | 1/1935 | Cross | 271/252 |
| 1,988,791 | 1/1935 | Harrold | 271/252 |
| 2,840,373 | 6/1958 | Socke | 271/252 |
| 3,663,011 | 5/1972 | Mowry et al. . | |
| 4,227,685 | 10/1980 | Fischer | 271/252 |
| 4,245,836 | 1/1981 | Joosten | 271/252 |
| 4,805,892 | 2/1989 | Calhoun . | |

FOREIGN PATENT DOCUMENTS

| | | | |
|---|---|---|---|
| 1761358 | 8/1973 | Fed. Rep. of Germany | 271/252 |
| 445376 | 4/1936 | United Kingdom . | |
| 2166420 | 5/1986 | United Kingdom . | |

*Primary Examiner*—Robert P. Olszewski
*Assistant Examiner*—Steven M. Reiss
*Attorney, Agent, or Firm*—Herbert L. Lerner; Laurence A. Greenberg

[57] ABSTRACT

A device conveys and aligns sheets on a feed table of a printing machine having a single-sheet feeder, an aligning section, and a conveying device revolving on shafts for conveying the sheets in a direction across the aligning section to feed rollers for feeding the sheets to an impression cylinder. Bearings are secured to side frames of the feed table so as to be cyclically adjustable in elevation. The shafts are rotatably mounted in the bearings and are cyclically displaceable laterally to the sheet-conveying direction. A guide device is secured in the side frames. A feed plate is carried by the guide device above the feed table and is laterally adjustable with respect to the position thereof on the guide device. The conveying device includes a revolving conveyor device disposed below the feed plate. The feed plate is formed with aligning edges disposed laterally forward of and behind the revolving conveyor device and constitutes a lateral aligning limit. A lower edge of the feed plate extends contact-free over the revolving conveyor device.

15 Claims, 14 Drawing Sheets

3
2
15,16
5
7
9
8
10
52
6

Fig. 11
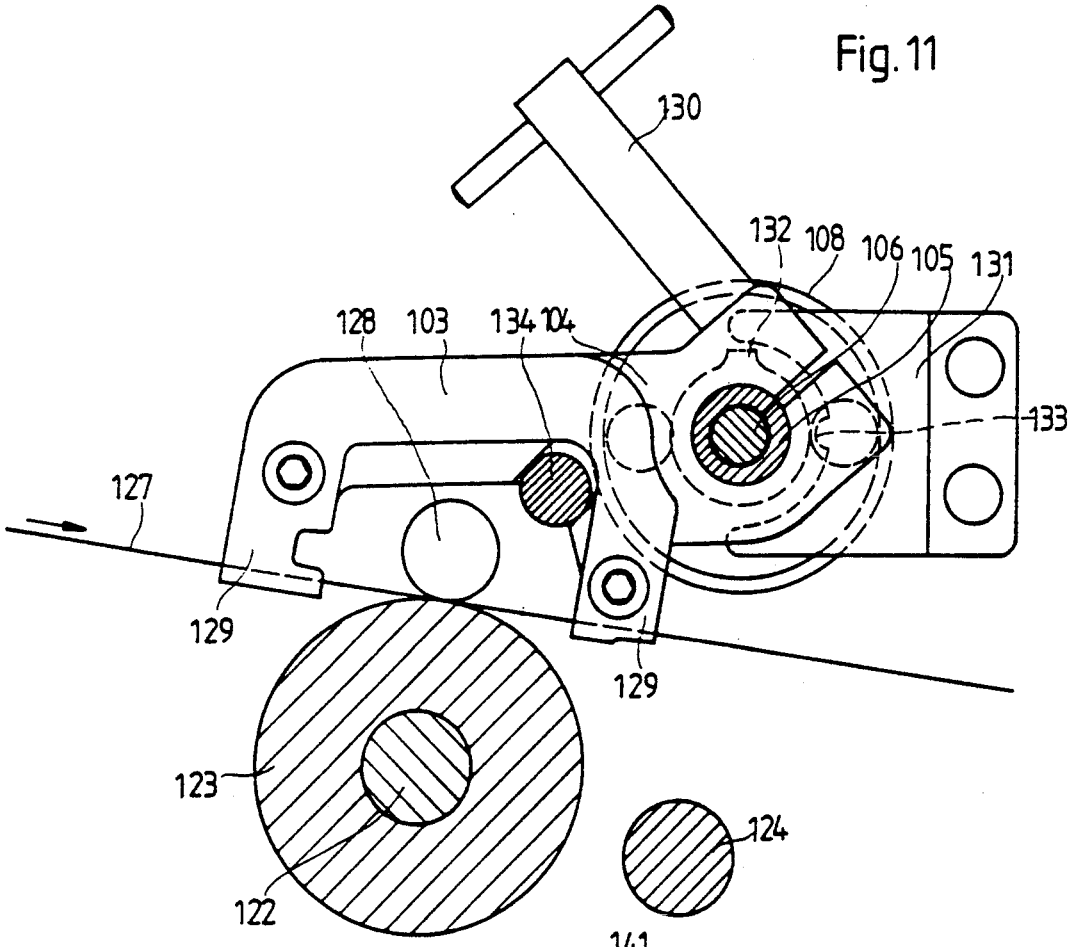
Fig. 12
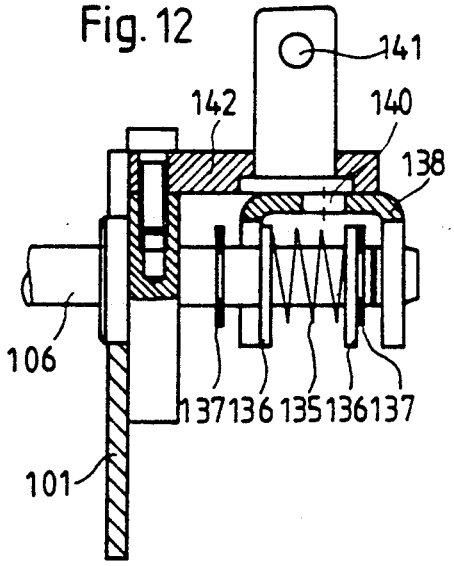
Fig. 13
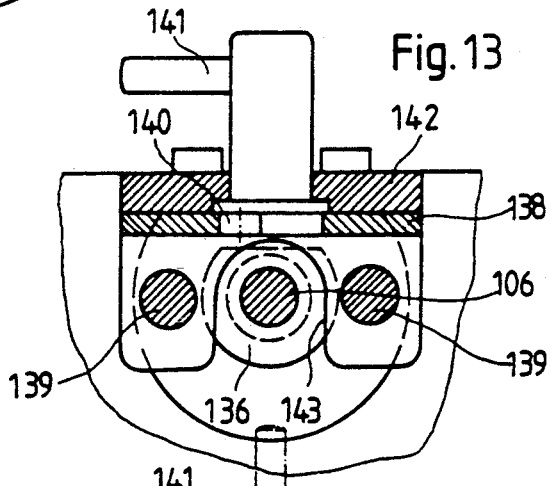
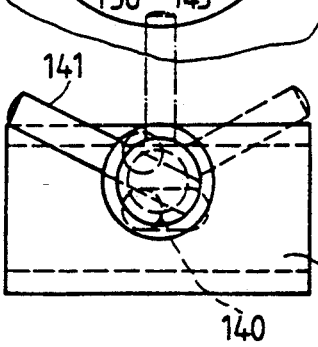
Fig. 14

DEVICE FOR CONVEYING AND ALIGNING SHEETS ON A FEED TABLE OF A PRINTING MACHINE

The invention relates to a device for conveying and aligning sheets at a feed table of a printing machine having a single-sheet feeder, an aligning section, and conveying means revolving on shafts for conveying the sheets across the aligning section to feed rollers for feeding the sheets to a gripper bar provided in an impression cylinder.

German Published Non-Prosecuted Application (DE-OS) 20 58 606 discloses a device of this general type which is a complicated and awkward system of various successive and partly overlapping conveying and aligning means. First of all, the aligning section is provided with revolving conveyor tapes for conveying the sheets. Between the tapes, suckers which, via racks, are alternatively moved forward and backward for conveying and pre-aligning the sheets are provided in a first region of the aligning section. In a second region of the aligning section, revolving front lays at which the sheet is aligned by its leading edge are secured on chains and disposed parallel to the revolving conveyor tapes. Moreover, awkwardly operating lateral means performing the final lateral alignment are located in the second aligning region. Driven brushes disposed above the feed table cover the sheet obliquely forwardly towards lateral aligning limits formed of tape surfaces of further driven and laterally tilted revolving tapes. As a whole, such a device is extremely expensive and complicated with respect to its construction and its drive control system. The device includes a large number of interlocking conveying and/or aligning means (i.e. suckers, conveyor tapes, front lays, brushes and lateral aligning limits, all running in different ways, which have to be driven separately in accordance with the machine cycle. In order to perform format adjustments, further expensive and complicated measures have to be taken. The guide means for the sucker motion, the brushes and the rotating lateral aligning limit must be laterally displaceable, some of the front lays must be constructed so that they are able to swing away because of the little space which is available, and the conveyor tapes must differ in length. The drive means for the sucker motion, the brushes and the revolving lateral aligning limits must be adapted to the adjustability. Consequently, satisfactory format adjustments require enormous expense for construction and are very time-consuming for the machine operator, without taking into account the fact that such a heretofore known device is not designed at all for using different sheet sizes. Even when transport of the sheets is taken over by the feed rollers which are arranged downstream of the aligning section, the end portion of the sheet is still subjected to the force and the transport actions of the conveyor tapes acting upwardly from below, of the brushes acting downwardly from above, of the brushes acting outwardly from the inside, of the rotating lateral aligning limits acting inwardly from the outside, and in combination, all acting forwardly from behind. In order to enable the feed rollers to grip a sheet, even for the smallest format size possible with this construction, this collection of conveying means, of course, is located close to the feed rollers. This means, however, that longer sheets with their end portions are subjected to these additional force and transport effects for a relatively long period of time after having been taken over by the feed rollers at their leading sheet edges. The sheets may be damaged or misaligned. As a result thereof, such a device does not ensure a reliable and exact transport and alignment after the sheet size or format has been changed.

In practice, it is often necessary to print sheets on both sides thereof, without having specific perfecting machines available in the print shop for this purpose. In such cases, the sheet pile containing sheets which have already been printed on one side thereof is turned 180° by the pressman, who then feeds the sheets a second time to the feeder of the printing machine. In order to apply the second print precisely in-register, however, it is advantageous to align each sheet at the same edge which was used for aligning the sheet for the first print.

It is accordingly an object of the invention to provide a device for conveying and aligning sheets on a sheet table of a printing machine wherein an exact and reliable transport and alignment of a sheet is optimized.

It is a further object of the invention to provide such a device which, in a first form printing and perfecting machine with double feeding of the sheet pile, will readily convert the lateral sheet-aligning means from one side to the other without play and with little effort.

With the foregoing and other objects in view, there is provided, in accordance with the invention, a device for conveying and aligning sheets on a feed table of a printing machine having a single-sheet feeder, an aligning section, and conveying means revolving on shafts for conveying the sheets in a direction across the aligning section to feed rollers for feeding the sheets to an impression cylinder, comprising bearings secured to side frames of the feed table so as to be cyclically adjustable in elevation, the shafts being rotatably mounted in the bearings and being cyclically displaceable laterally to the sheet-conveying direction, guide means secured in the side frames, a feed plate carried by the guide means above the feed table and being laterally adjustable with respect to the position thereof on the guide means, the conveying means including a revolving conveyor device disposed below the feed plate, the feed plate being formed with aligning edges disposed laterally forward of and behind the revolving conveyor device and constituting a lateral aligning limit, a lower edge of the feed plate extending contact-free over the revolving conveyor device.

The revolving conveyor device frictionally engaging the sheet from below is laterally displaced towards the lateral aligning limit the instant it reaches the leading sheet edge. In so doing, the sheet is laterally aligned at the aligning limits. The instant the sheet reaches the feed rollers, the conveyor device is entirely lowered below the table plate and is laterally moved back under the table plate, into its original position. The sheet is in the interim transported by the feed rollers away from the radius of action of the conveyor device. For conveying the following sheet, the conveyor device is lifted again upwardly into its original position for conveying the following sheet.

With the device for conveying and aligning sheets, according to the invention, it is merely necessary to drive one single conveyor device and to change its position with respect to the sheet transport across the aligning section up to the feed rollers and with respect to its lateral alignment. All driving and displacing means which are used may extend from below the feed table up to the conveyor device, whereby a compact construction of the drive device is realized. Format changes do not require specific adjustments of the conveying and aligning means; it is merely necessary laterally to adjust the lateral aligning limit by adjusting the feed plate. Because the conveying means is lowered below the table after the sheet transport is taken over by the feed rollers, and thus the sheet is then subjected only to the transport effect of the feed rollers, and the sheet slides across the table along the lateral limit with its trailing portion facing in direction towards the feed rollers, it is also possible continuously to convey formats which are longer than the machine-related minimum sheet size and to ensure lateral sheet alignment as well as a reliable and exact sheet feed, even for a short feed table.

In accordance with another feature of the invention, the revolving conveyor device is movable between a raised and a lowered position thereof, and there are provided balls freely rotatable in all directions and supported by their own weight on the revolving conveyor device in a raised position of the latter, guide bushings for receiving the balls therein so that the balls are movable substantially perpendicularly to the sheet-conveying direction, the guide bushings having retaining means for preventing the balls from falling through the guide bushings in the lowered position of the revolving conveyor device.

Freely rotatable balls resting on the revolving conveyor device during sheet conveying and lateral aligning by the revolving conveyor device reinforces the frictional contact between the sheet and the conveyor device, which ensures an exact and reliable transport and lateral alignment of the sheets, especially for higher conveying speeds.

In accordance with a further feature of the invention, the revolving conveyor device is formed of at least one conveyor roller of substantially uniform diameter firmly mounted on one of the shafts, and there are provided drive means for driving the one shaft.

If the revolving conveying means are formed only of a driven shaft having conveyor rollers secured coaxially thereon, this permits a simple and compact construction of the conveying means and the feed table, and the drive and control for the conveying means, thus ensuring a particularly reliable transport and alignment, even for especially short feed tables and paper sheets having varying sheet sizes or formats.

In accordance with an additional feature of the invention, there are provided respective levers secured to outer sides of the side frames so as to be pivotable about a pivot axis on the respective side frames, the side frames being formed with openings through which the shafts of the conveying means project freely movably outwardly, the bearings wherein the shafts are rotatably and displaceably mounted being coaxially secured to the levers, and means for reciprocatingly pivoting the levers upwardly and downwardly in accordance with the printing-machine cycle.

Mounting the shafts in levers which are provided at the outer sides of the table and which are pivoted or swung in a vertical direction in accordance with the machine cycle is also beneficial to a compact setup and an exact and reliable upwardly and downwardly pivoting with a relatively simple construction of the bearings.

In accordance with an added feature of the invention, there are provided respective levers secured to outer sides of the side frames so as to be pivotable about a pivot axis on the respective side frames, the side frames being formed with openings through which the one shaft of a plurality of the conveyor rollers projects freely movably outwardly, the bearings wherein the shaft is rotatably and displaceably mounted being coaxially secured to the levers, means for reciprocatingly pivoting the levers upwardly and downwardly in accordance with the printing-machine cycle, the one shaft having at least one extension projecting outwardly through a respective bearing at one of the levers, the drive means for driving the one shaft and the conveyor rollers, and means for laterally displacing the one shaft and the conveyor rollers being operatively connected to the projecting extension.

With such a shaft, if drive means as well as lateral displacement means act on an extension of the shaft from the outside, this means that it is possible, to a great extent, to prevent the drive means and the displacing means from acting upon the interior space between the side frames of the feed table. The drive means and the displacing means may be compactly and observably located outside the side frames without taking up the narrow space available between the side frames.

Such an observable and compact arrangement provides the advantage of a feed table which is relatively easy to operate, as well as the use of precisely working drive mechanisms.

In accordance with yet another feature of the invention, the projecting extension of the one shaft is formed with a circumferential guidance groove with which a guide roller is in constant sliding contact, the guide roller having a rotational plane extending parallel to the axis of the one shaft, and there is provided an axial displacement lever having two lever arms and being pivotally mounted on a lateral mounting support located at the outer side of the respective side frame through which the shaft extension projects, the guide roller being rotatably mounted on one of the lever arms of the axial displacement lever, a control shaft supported in the side frames, an axial cam disk coaxially secured to an end of the extension projecting beyond the respective side frame, a sensing roller in constant contact with the axial cam disk along a cam contour of the axial cam disk, the sensing roller being rotatably mounted on the other of the lever arms of the axial displacement lever.

A preferred and particularly advantageous embodiment of simple and reliable lateral displacement means which ensure an extremely simple and reliable alignment is thereby provided.

In accordance with yet a further feature of the invention, there is provided a gearwheel firmly seated on the projecting extension of the one shaft, a drive shaft coaxial with the pivot axis extending in the form of a journal at both ends thereof through the side frames and being rotatably supported in the side frames of the feed table, the levers being freely rotatably mounted in axially fixed position, gearwheels securely mounted on the journals outside the levers, one of the levers having a pin whereon a gearwheel broader than the gearwheel seated on the extension of the one shaft is freely rotatably mounted yet fixed against axial movement, the broader gearwheel being in meshing engagement with the gearwheel on the extension and with a respective one of the gearwheels mounted on one of the journals, the control shaft having an extension projecting outwardly through the respective side frame located opposite the axial cam disk, a gearwheel secured on the last-mentioned control shaft extension, a gear train disposed between one of the gearwheels mounted on the journals outside of the levers and the gearwheel secured on the control shaft extension, a radial sensing roller having an axis of rotation extending parallel to the control shaft being freely rotatably mounted on an end of one of the two levers located opposite to a respective pivot axis extending through one of the respective bearings, and a radial cam disk corresponding to the radial sensing roller and in addition to the axial cam disk being located on the same side of the feed table and coaxially secured to the control shaft outside the respective side frame of the feed table, the radial cam disk being in constant contact with the radial sensing roller.

An embodiment of a drive for the conveying means is thus provided which is particularly advantageous with respect to its construction and operational reliability, the lateral displacing drive and the upward and downward pivoting of the lever. The control of the axial cam disk and the radial cam disk is concentrated in a single driven control shaft.

In accordance with yet an additional feature of the invention, the axial cam disk and the radial cam disk are secured to the same extension of the control shaft. All of the control means may thus be assembled in a compact manner on only one side of the feed table.

In accordance with a further feature of the invention, there are provided drive means for the shafts, means for laterally displacing the shafts in the bearings and lifting means for raising and lowering the bearings, respectively, the drive means, the lateral displacement means and the lifting means having a common gear train extending to a printing unit of the printing machine. Thus, space-saving and easy-to-operate drive means permitting a particularly reliable drive are provided.

Lateral aligning limits in the form of feed plates which are laterally adjustable with respect to the lateral position thereof and which are free of contact with the revolving conveyor device permit a particularly simple format adjustment. Even with a short feed table, the sheet may be laterally brought by the conveying means into abutting relation with the aligning edges provided in front of and behind the conveyor device and be precisely aligned at the interrupted edges as if they were one long edge. Such an aligning limit is adjustable with respect to the entire format range and is restricted neither by the conveying means with its drive nor by the drive itself nor by the control means for lateral alignment.

In accordance with another feature of the invention, the lower edge of the feed plate, directly forward of and behind the revolving conveying device is formed with downwardly directed extension as lay edges which are free from contact with the revolving conveying device. The foregoing provides a preferred embodiment of the lateral aligning limit. The construction of the feed plate with the extension serving as lay edges is relatively simple, precisely adjustable, easy easy to replace, easy to operate and to maintain, thus also serving the purpose of exact sheet alignment.

In accordance with an additional feature of the invention, there are provided front lays rotatably guided over the region of the revolving conveying device, the front lays having a rear reversal point in vicinity of the feed rollers, and being operatively connected with a drive shaft at a respective reversal point, and a gear train extending from the drive shaft to a printing unit of the printing machine.

In an especially favorable additional development, front lays rotating over the region of the revolving conveyor device thus provide additional features which complete the entire, reliable and exact conveying and aligning process which is performed along the side edge and additionally at the leading sheet edge. The rotating front lays, which have a speed somewhat lower than the speed of the conveyor sheet, provide a continuous and exact aligning of the sheet at its leading edge, even at high conveying speeds.

In accordance with an additional feature of the invention, there are provided drive means for said shafts, means for laterally displacing said shafts in said bearings and lifting means for raising and lowering said bearings, respectively, said drive means, said lateral displacement means and said lifting means having a common gear train extending to a printing unit of the printing machine.

In accordance with another feature of the invention, there is provided another feed plate located at the other side of the sheets fed thereto for alternatingly aligning the sheets, said revolving conveyor device comprising a conveyor roller for moving the sheets towards said feed plates, and a double control cam for axially displaceably driving said conveyor roller so as to bring the sheets into lateral contact alternatively with one of said feed plates.

This construction permits the pressure to convert the aligning means provided on the feed table before printing on the second sheet side so that, even with a sheet pile which has been turned over, each sheet is aligned at the same edge in order to achieve an optimum register accuracy, which is especially advantageous if the sheets to be processed differ somewhat in size.

In accordance with a further feature of the invention, there is provided a cam roller assigned to said double control cam for transmitting, via a double lever, a first control roller and a grooved disk, a stroke movement to a journal of said conveyor roller, a compression spring for transmitting spring force via a push rod carrying another grooved disk to a second control roller, said second control roller pressing said cam roller against one of said cam disks of said double control cam via said double lever, and a counterbearing via which the direction of the force of said compression spring is reversible with respect to the direction of application thereof.

In accordance with an added feature of the invention, said compression spring is mounted on said push rod and has a respective retaining ring for limiting the extension thereof on both sides thereof, said compression spring being surrounded by said counterbearing in longitudinal direction of said spring, said counterbearing being guided on sliding guides and being axially displaceable for converting the lateral abutment of the sheets against said feed plates by means of an eccentric pin so that one alternative side of said compression spring is braced against said counterbearing, and the other side thereof is braced against a retaining ring and so that the force acts in one alternate direction.

In accordance with a concomitant feature of the invention, there is provided a common tubular traverse whereon said feed plates disposed on both sides of the sheets are secured, said tubular traverse being mounted on said push rod, and a handwheel with a threaded guide for laterally adjusting said tubular traverse.

Other features which are considered as characteristic for the invention are set forth in the appended claims.

Although the invention is illustrated and described herein as embodied in a device for conveying and aligning sheets on a feed table of a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIGS. 1*a* and 1*b* together constitute an overall diagrammatic side elevational view of a printing machine incorporating therein the device according to the invention;

FIGS. 2*a* and 2*b* together are an enlarged fragmentary side elevational view of FIGS. 1*a* and 1*b*;

FIGS. 3*a* and 3*b* together are a plan view of FIGS. 2*a* and 2*b;*

FIGS. 4*a* and 4*b* together are a cross-sectional view of FIG. 2*b* taken along the line 4—4 in the direction of the arrows and showing, by way of example, a conveying system having a support for balls;

FIGS. 5*a* and 5*b* together are a cross-sectional view of FIG. 2*a* taken along the line 5—5 in the direction of the arrows and showing driven return guide rollers of the front lays;

FIG. 11 is a fragmentary cross-sectional view of FIG. 8 taken along the line XIII—XIII in the direction of the arrows;

FIG. 12 is a slightly enlarged fragmentary longitudinal sectional view of FIG. 8 taken along the line XII—XII in the direction of the arrows and showing the converting mechanism in greater detail;

FIG. 13 is a fragmentary cross-sectional view of FIG. 8 taken along the line XIII—XIII in the direction of the arrows and further showing the converting mechanism; and FIG. 14 is a fragmentary plan view of the converting mechanism.

Figure 1A:
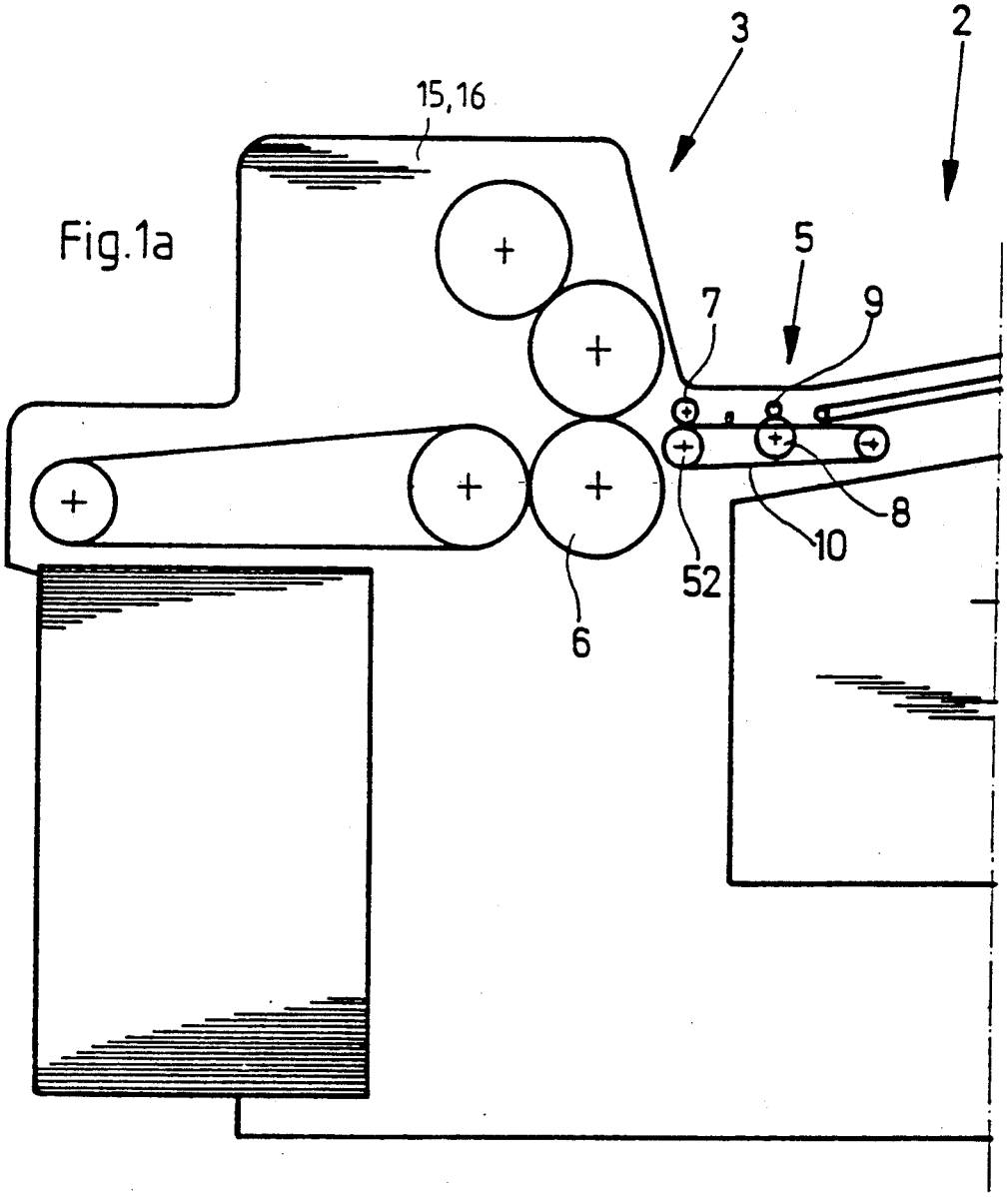
Figure 1B:
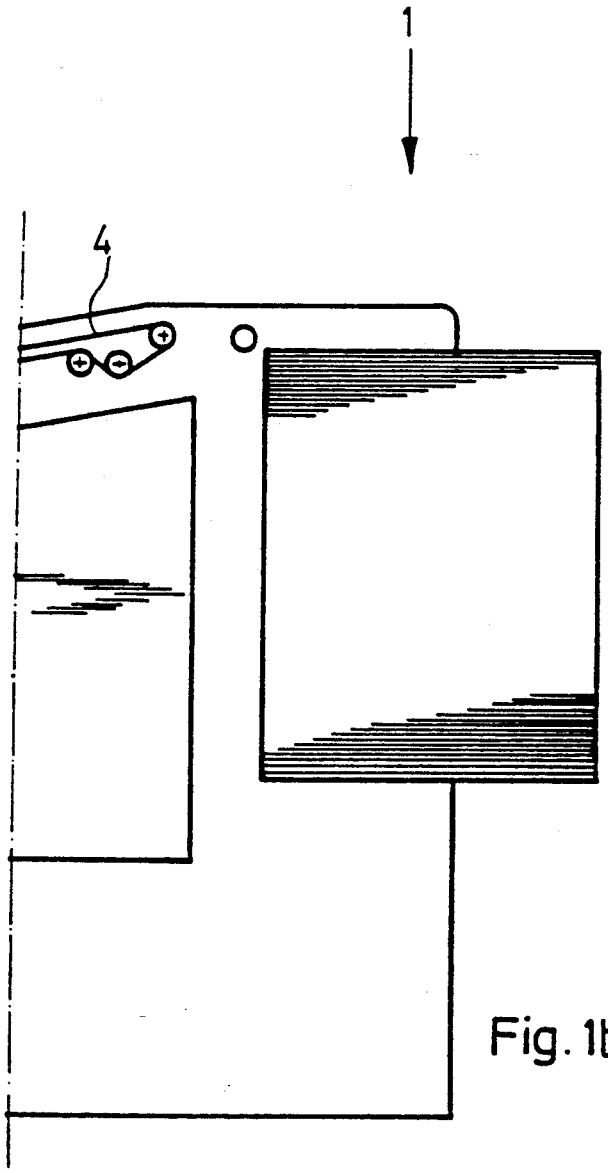
Figure 5A:
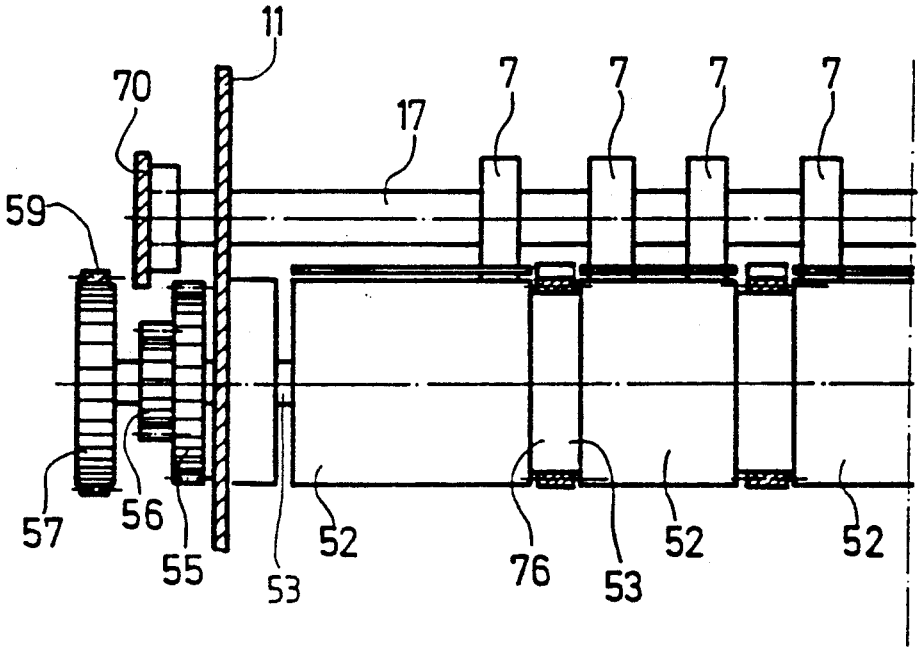
Figure 5B:
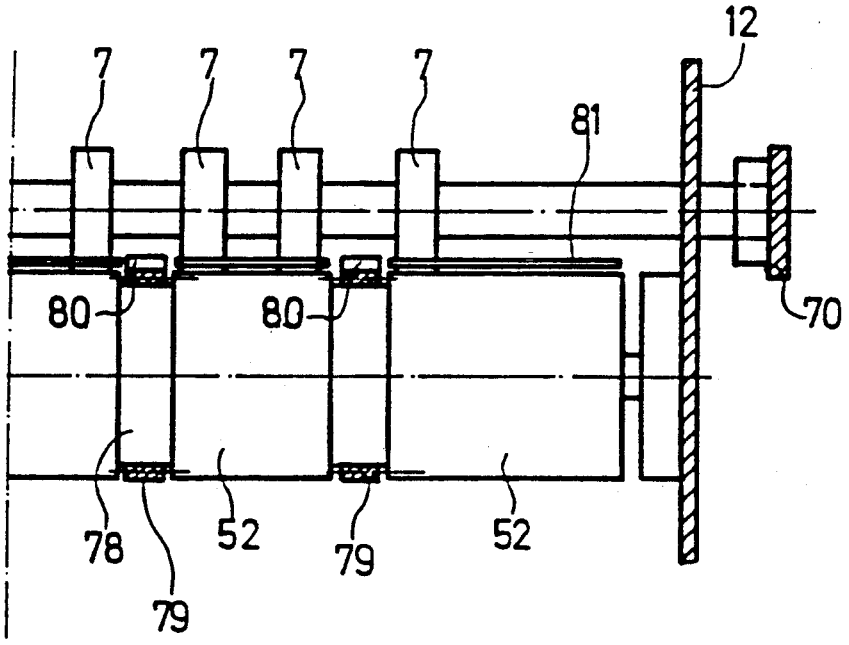

Referring now to the drawings and, first, particularly to FIGS. 1*a* and 1*b*, there is shown therein how paper sheets are conveyed from a sheet pile 1 to a printing unit 3 across a feed table 2 of a sheet-fed offset printing machine having a single-sheet feeder. In the embodiment illustrated in FIGS. 1*a* and 1*b*, the paper sheets are transported to a conveying and aligning section 5 by conveyor tapes 4. Thereafter, corresponding feed rollers 7, 52 bring the paper sheets into an abutting relationship with a non-illustrated gripper bar conventionally provided in an impression cylinder 6. The impression cylinder 6 is supported in machine side frames 15, 16, only one of which is shown in FIGS. 1*a* and 1*b*, and, as shown in FIGS. 5*a* and 5*b*, shafts 17 and 53, respectively, of the feed rollers 7 and 52 are supported in the side frames 11 and 12, respectively, of the feed table 2. Rotating conveying means 8 and revolving front lays 10 are located in the conveying and aligning section 5.

Figure 3A:
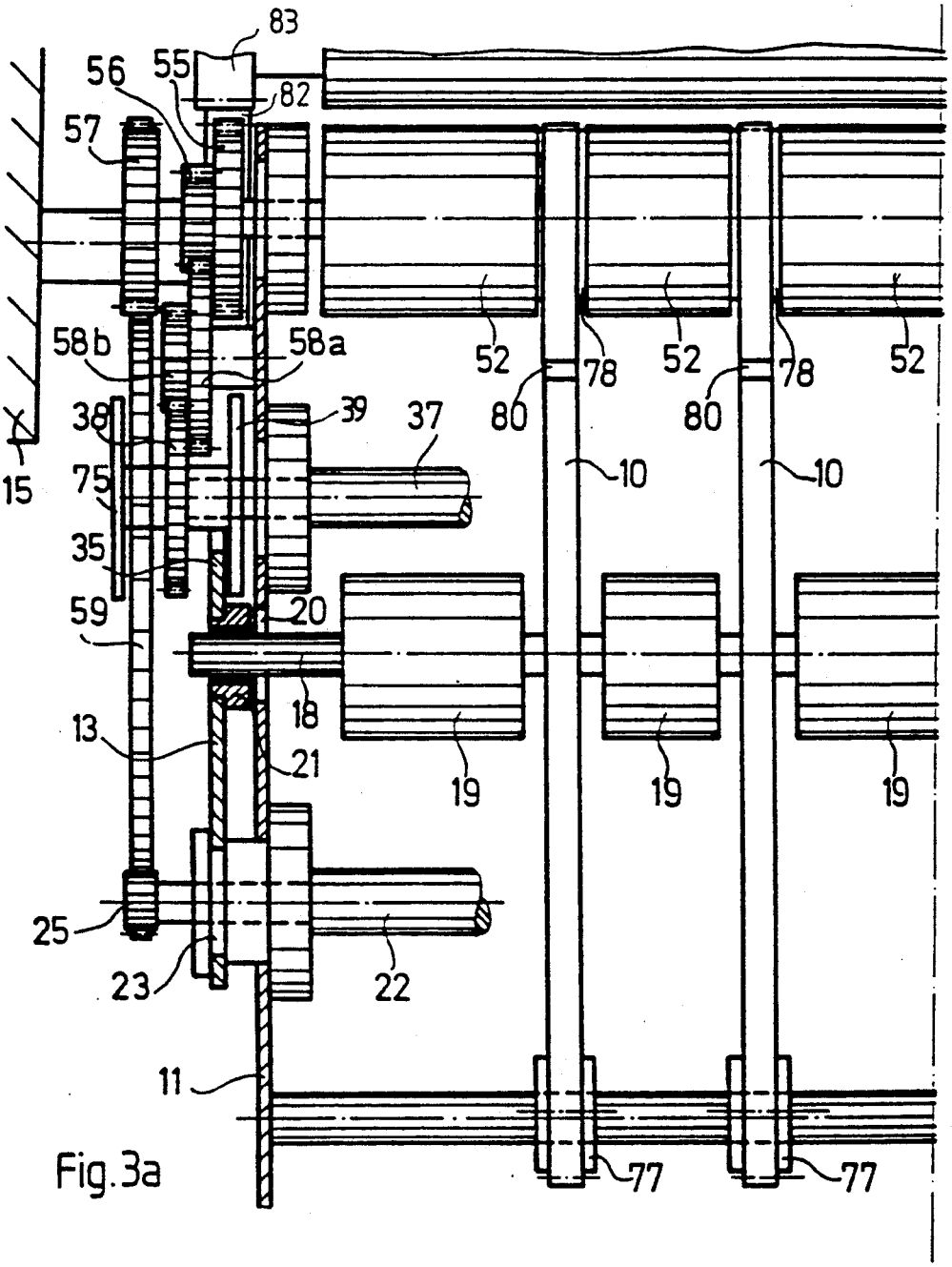
Figure 3B:
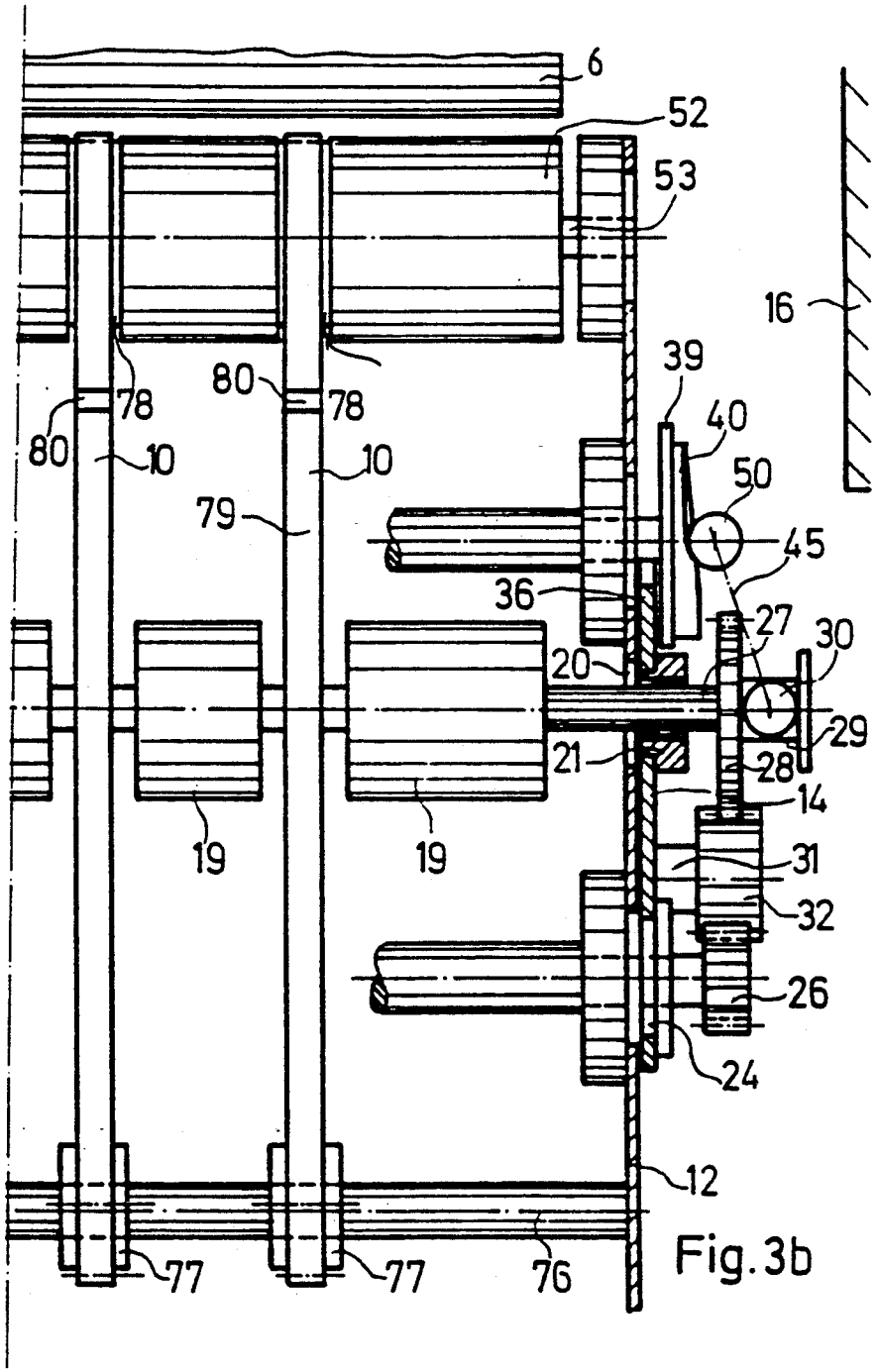
Figure 4A:
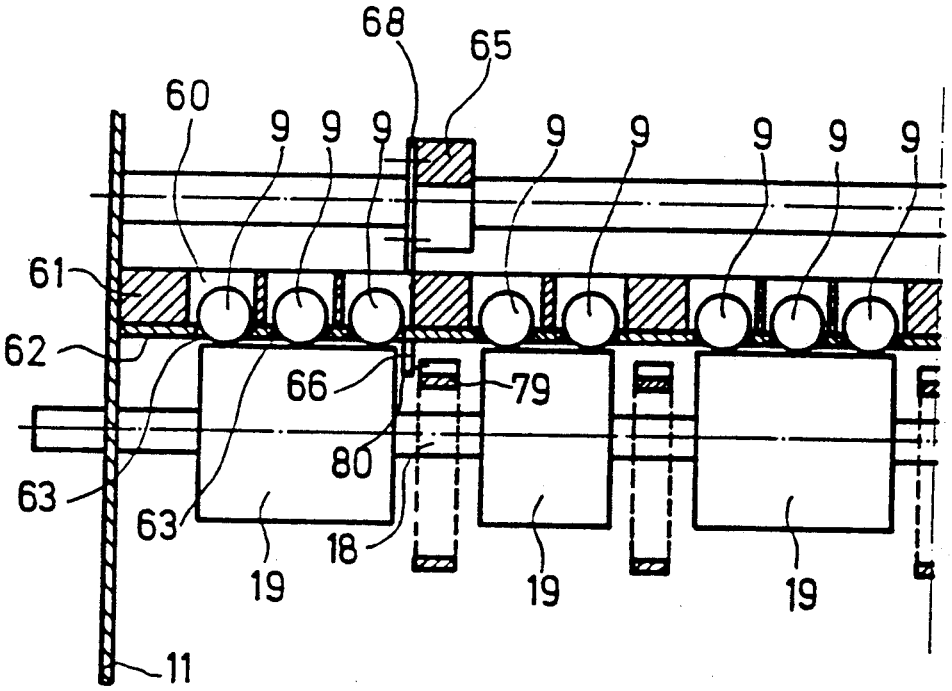
Figure 4B:
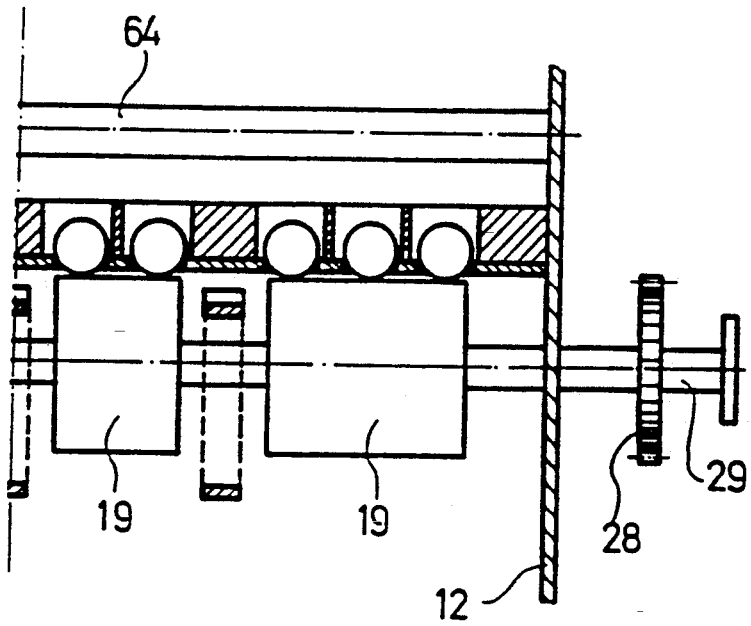

As shown in FIGS. 3*a* and 3*b*, a shaft 18 of the revolving conveying means 8 on which a revolving conveyor device or conveyor rollers 19 are secured extends, at both side thereof, through openings 20 formed in the side frames 11 and 12 of the feed table 2 and is rotatably mounted in bearings 21 outside of the side frames 11 and 12. The bearings 21, in turn, are secured in though-bores formed in levers 13 and 14. The levers 13 and 14 are rotatably mounted on a shaft 22 in bearings 23 and 24 located outside the side frames 11 and 12, the shaft 22 being, in turn, rotatably mounted in the side frames 11 and 12 at a location upstream or forward of the conveyor rollers, as viewed in sheet-conveying direction. Gears 25 and 26 are provided on outwardly extending journals of the shaft 22.

The shaft 18 has an extension forming a journal 27 which extends beyond the right-hand side frame 12, as viewed in FIG. 3*b*, and the respective bearing 21 provided in the lever 14, the extension of the shaft 18 being provided with a gearwheel 28 and formed with a deep circumferential groove 29 with which an axial displacement roller 30 is in operative sliding contact.

A broad gearwheel 32 meshing with the gearwheels 26 and 28 is rotatably mounted on a pin 31 provided on the lever 14.

As shown further in FIGS. 3*a* and 3*b*, a control shaft 37 extending, like the shafts 18 and 22, transversely across the width of the feed table 2 is located downstream of the conveyor rollers 19, as viewed in conveying direction, and is rotatably mounted below a table plate (which, in the interest of clarity, is not illustrated) in the side frames 11 and 12 which carry the table plate. The control shaft 37 extends through and beyond the two side frames 11 and 12 and lies outside the range of action of the lever 14. A gearwheel 38 is secured to an extension of the control shaft 37 located at the left-hand side of FIG. 3*a*. A respective radial cam disk 39 is secured on each of the two extensions of the control shaft 37, and an axial cam disk 40 is further secured to an end face of the extension of the control shaft 37 at the right-hand side of FIG. 3*b*.

Figure 2A:
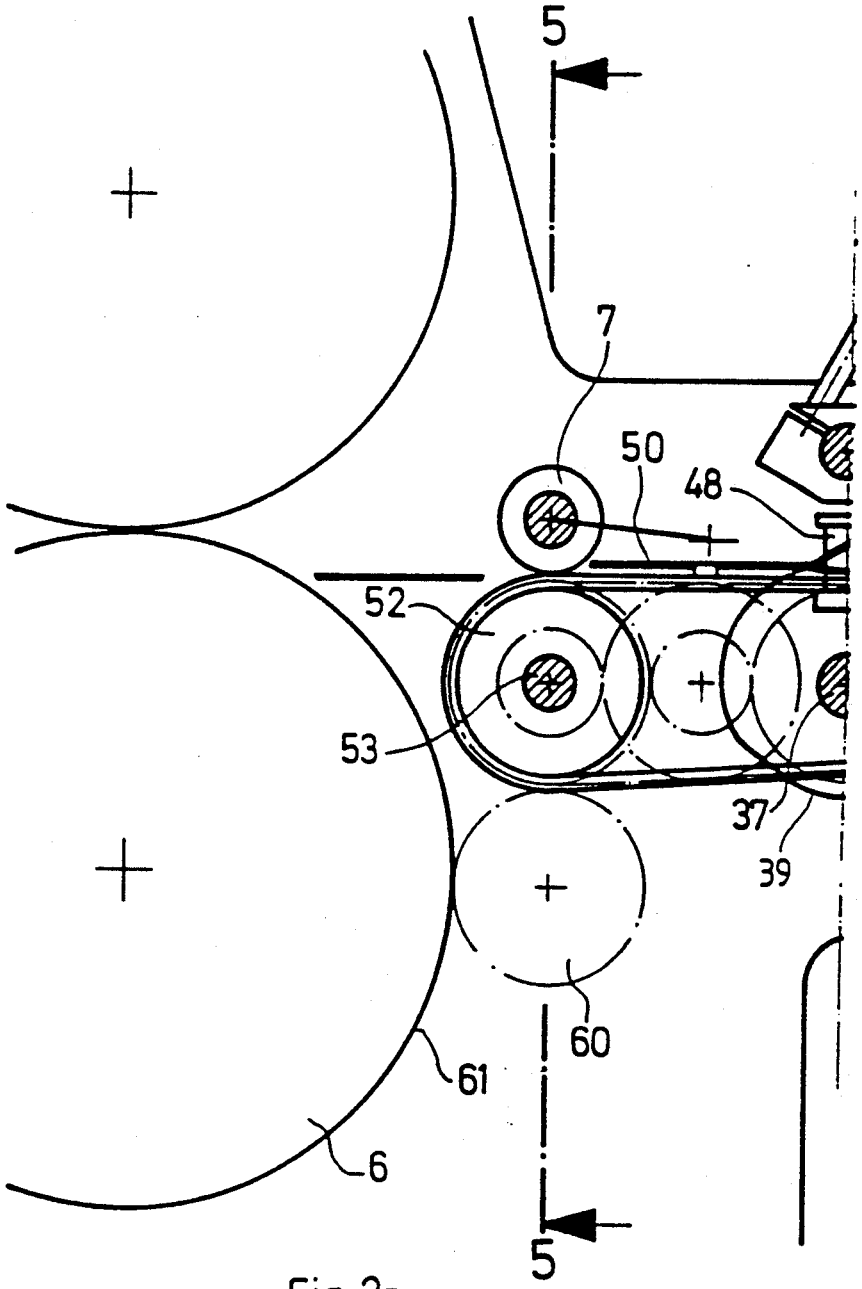
Figure 2B:
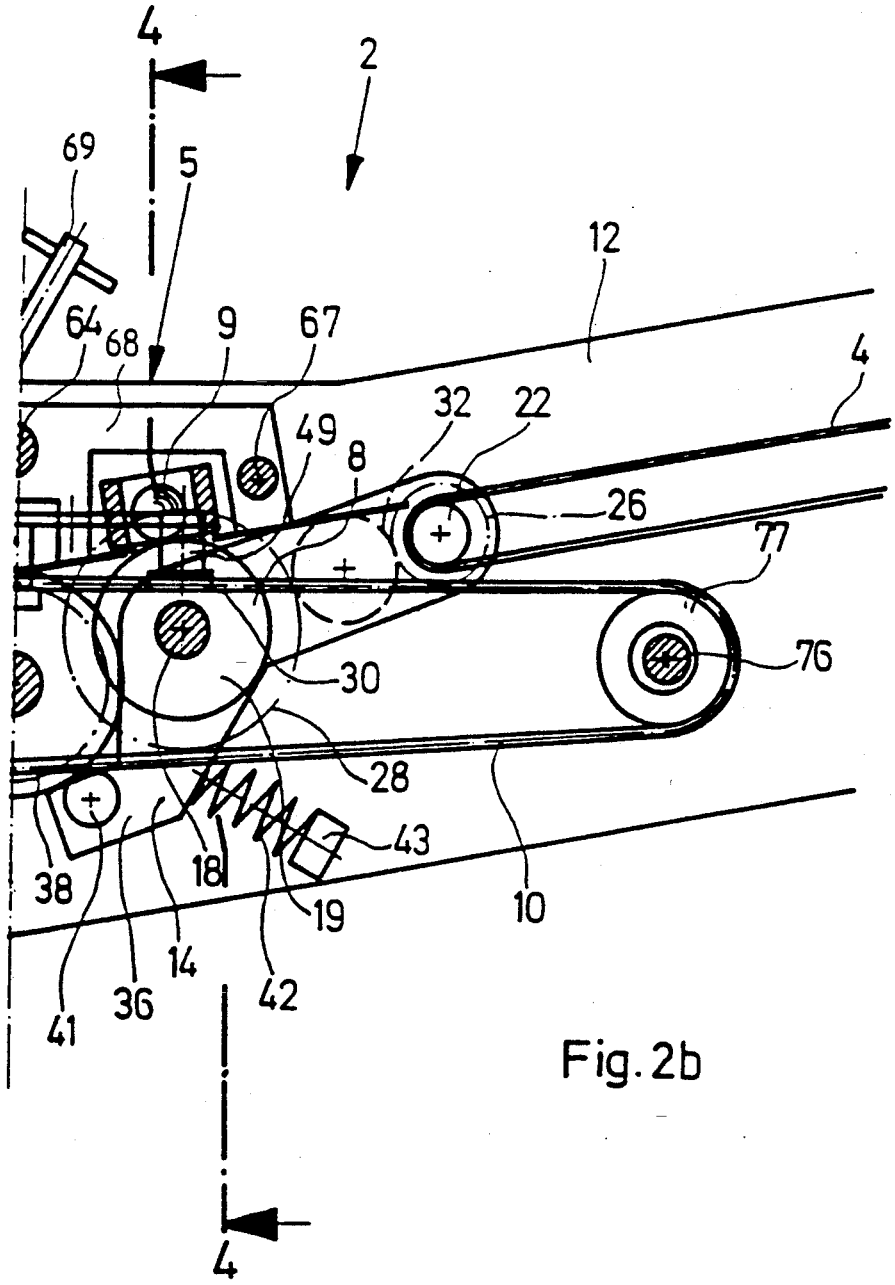

A respective radial sensing roller 41, as shown in in FIGS. 2*a* and 2*b*, has a circumferential surface which is brought into contact with the corresponding radial cam disc 39 from below. The sensing rollers 41, respectively, are rotatably mounted at respective ends 35 and 36 of the levers 13 and 14, the lever ends 35 and 36 being located opposite the respective rotatable bearings 23 and 24 of the shaft 22. In order to maintain this contact between the respective roller 41 and cam disk 39, a respective spring 42, which is braced against a support 43 attached to the respective outside of the side frames 11 and 12, engages the underside of the lever ends 35 and 36, respectively.

Figure 6:
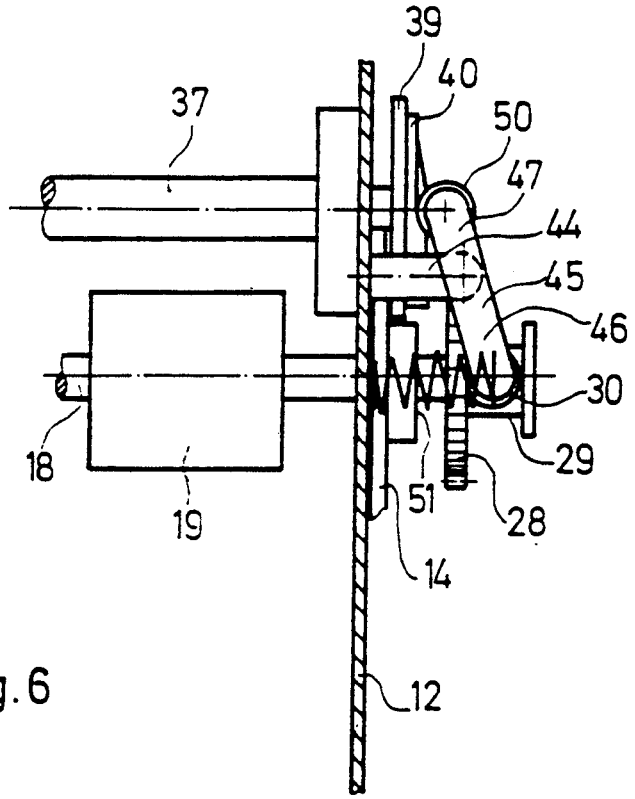
FIG. 6 is a fragmentary view of FIG. 3*b* showing a lateral displacing mechanism thereof in greater detail.

An axial displacement lever 45, as shown in greater detail in FIG. 6, has two lever arms 46 and 47 and is pivotally mounted in a mounting support 44 which is secured to the outside of the side frame 12 above common tangential planes of the shafts 37 and 18 and outside the range of action of the lever 14. The ends of the two lever arms 46 and 47 are provided with downwardly directed pins 48 and 49, as shown in FIGS. 2*a* and 2*b*, an axial sensing roller 50 and the axial displacement roller 30, respectively, being rotatably mounted at each lower end of the pins 48, 49. The axial sensing roller 50 is in constant contact with the axial cam contour of the axial cam disk 40. In order to maintain this contact, a spring 51 is braced between non-illustrated support bearings against the axial displacement lever arm 46 and the side frame 12 of the feed table.

At the end of the feed table 2, as seen in the conveying direction, the feed rollers 52 and 7 are secured on the shafts 53 and 17, respectively, extending transversely to the conveying direction and across the width of the feed table 2. The shaft 53 of the feed roller 52 is rotatably mounted in the side frame 11 below the table plate. The gearwheels 55, 56 and 57 are secured on an extension of the shaft 53 projecting outward through the left-hand side frame. In a conventional manner, the gearwheel 55 is drivingly connected with the impression cylinder 6, e.g., via a ring gear 82 and a gearwheel 83. Via intermediate gearwheels 58*a* and 58*b* which are mounted on a bearing pin rotatably supported at the left-hand side frame 11, the gearwheel 56 meshes with the gearwheel 38. The gearwheel 57 is drivingly connected to the gearwheel 25 of the shaft 22 via a toothed endless tape or belt 59.

As shown in FIGS. 2*a*, 2*b*, 4*a* and 4*b*, a traverse 61 is secured between the side frames 11 and 12 across the width of the feed table 2, the traverse 61 having round guide bushings 60 which are aligned perpendicularly to the shaft 18 of the conveyor rollers 19 and to the conveying plane. Below the traverse 61, there is secured a retaining metal sheet 62. Below the round guide bushings 60, the retaining metal sheet 62 is provided with circular through-openings 63 having a diameter which is smaller than the diameter of balls 9 loosely inserted into the guide bushings 60, so that the respective balls 9 form calottes which project downwardly through the openings 63 formed in the retaining metal sheet 62. With the conveyor rollers 19 swung upwardly, the balls 9 rest freely on the conveyor rollers 19 or on a sheet of paper, if a sheet of paper is present on the conveyor rollers 19. The instant the conveyor rollers 19 are moved downwardly, the balls 9 are also lowered until they rest on the edges or rims of the openings 63 formed in the remaining metal sheet 62. The conveyor rollers 19 are lowered below this collecting position of the balls 9. Depending upon the quality or character of paper, the format or other individual requirements, the balls 9 may be exchanged from above both as to the number thereof or the composition or nature thereof. The balls 9 may be axially positioned so that they are axially located above a conveyor roller 19 during the entire lateral displacement. Moreover, it is also conceivable to use other conventional ball-supporting devices, e.g., laterally adjustable guide bushings.

Above, and both in front of and behind the guide rollers 19, the guide rods 64 and 67 (FIGS. 2*a* and 2*b*), extending transversely across the width of the feed table 2, are fastened to the side frames 11 and 12. As shown more particularly in FIGS. 4*a* and 4*b*, a mounting support 65 having a metal sheet 68 attached to a side thereof facing towards the side frame 11 is mounted on the guide rods 64, 67 so as to be axially displaceable, the mounting support 65 and the metal sheet 68 bridging the ball-supporting traverse 61. In front of and behind the conveyor rollers 19, the metal sheet 68 is provided with extensions 66 extending downwardly below the conveying plane. These extensions 66 do not contact the conveyor rollers 19 and serve as lateral lay edges. For the purpose of laterally adjusting the position of the lay edges 66, the mounting support 65 is laterally fastenable by means of a vise-like device 69 or the like with respect to the guide rod 64.

The conveying and aligning device according to the invention operates as described hereinafter. From the impression cylinder 6, the shaft 53 is driven, via the gearwheel 55, synchronously and in accordance with the printing-machine cycle. The conveyor rollers 19 are driven synchronously via the drive connection 57, 59, 25, 22, 26, 32 and 28 and via the gear train 56, 58*a*, 58*b* and 38 of the control shaft 37. The control shaft 37 is thus driven synchronously and in accordance with the machine cycle. In the upper position of the conveyor rollers 19, with the aid of the supported balls 9, the conveyor rollers 19 take over the transport of the sheet fed from the feed pile 1 by the conveyor tapes 4. By suitably pivoting the axial displacement lever 45, the shaft 18, together with the conveyor rollers 19, is laterally displaced towards the lay edges 66; the pivoting motion is effected by the spring 51 which ensures that the roller 50 rolls on the axial cam disk 40. With the aid of the supported balls 9, the sheet is frictionally moved laterally to the lay edges 66 by means of the conveyor rollers 19 and aligned along a side edge thereof. During the lateral displacement, the gearwheel 28 maintains its meshing engagement with the gearwheel 32 due to the wider construction of the latter. The instant the leading edge of the sheet reaches the synchronously driven feed roller 52 which serve for further transport thereof, the conveyor rollers 19 are lowered with the aid of the levers 13 and 14. The lowering of the rollers 19 is controlled by the radial sensing roller 41 which, by means of the spring 42, rolls on the respective contour of the radial cam disk 39, 75.

The balls 9 are then supported or carried by the retaining metal sheet 62. The sheet with its trailing edge slides over the metal guide sheets of the feed plate. In cooperation with the spring 51, the axial cam disk 40 then causes the axial return of the conveyor rollers 19, and the radial cam disks 39, 75, in cooperation with the spring 42, causes the lifting of the levers 13, 14 and the conveyor rollers 19 in time for conveying the next following sheet.

Figure 7:
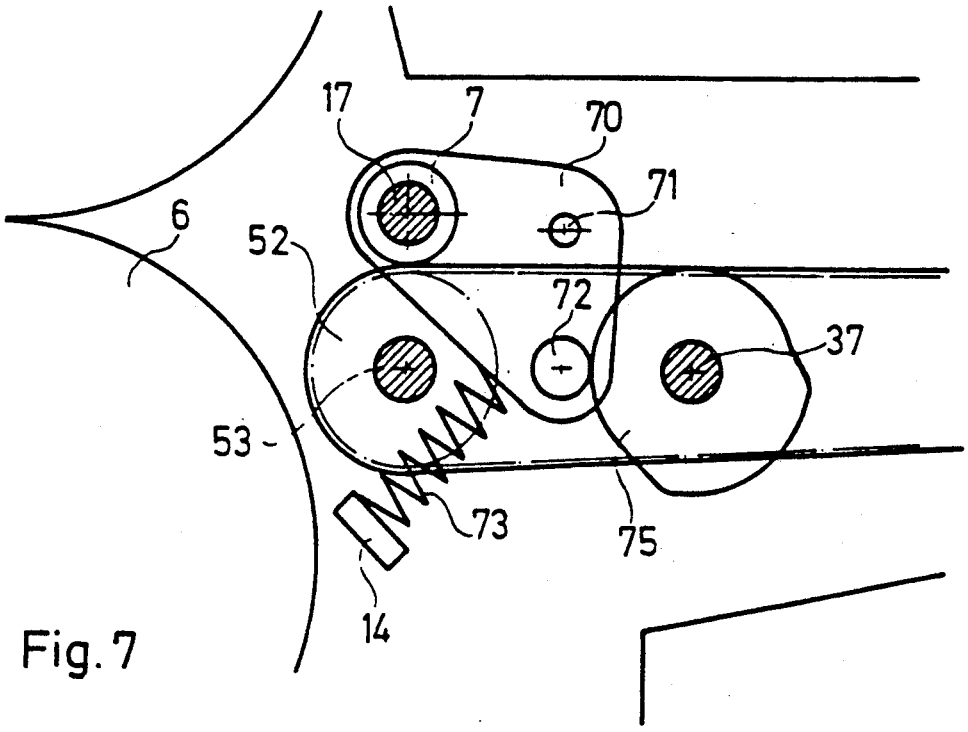
FIG. 7 is a view very much like that of FIG. 2*a* but further showing a control for the feed rollers.

The feed rollers 52 are driven by the gearwheel 55 via the shaft 53. As illustrated in FIGS. 5 and 7, the feed rollers 7 cooperating with the feed rollers 52 in accordance with the printing-machine cycle may be secured, e.g., on a shaft 17 extending across the width of the feed table 2 and supported, on both sides thereof, in a lever 70.

The levers 70 are rotatably mounted on a respective bearing pin 71 provided at the side frames 11 and 12. A sensing roller 72 is rotatably mounted, at least, on one lever arm of a lever 70. Via a spring 73 acting on the lever 70 and being braced against a mounting support 74 provided at the side frame 11, the sensing roller 72 is in constant friction contact with a cam of the radial cam disk 75 which, e.g., is also secured on the control shaft 37 (note FIGS. 3*a*, 3*b* and 7). Thus, it is possible also to pivot the feed rollers 7 reciprocatingly up and down in accordance with the machine cycle, and the conveyor rollers 19 as well, by means of one and the same control shaft 37.

In a preferred embodiment of the device for conveying and aligning, according to the invention, rotating front lays 10, as illustrated in the figures, have additionally been provided. Seen in the conveying direction, a shaft 76 is rotatable mounted between the side frames 11, 12 upstream of the conveyor rollers 19, as shown in FIGS. *2a*, *2b*, *3a* and *3b*. Synchronously running tapes 79 having leading-edge stops 80 fastened thereon and projecting upwardly through slits provided in the guide plates 81 of the table plate run around the rollers 77, which are fastened on the shaft 76, and around the rollers 78, which are secured on the shaft 53 between the feed rollers 52, as can be seen in FIG. 5.

In the vicinity of the revolving conveyor rollers 19, the tapes 79 pass through the spaces between the conveyor rollers 19, as illustrated in FIGS. *2a*, *2b*, *3a* and *3b*. The spacing of the conveying rollers 19 with respect to one another is of such dimension that axial play remains between the the tapes during the lateral displacement of the conveyor rollers 19. The spacing between the upper and the lower strand of the tapes 79 is selected so that there is radial play with respect to the strands during the reciprocative pivoting or swinging of the shaft 18 arranged between both strands (note FIGS. *2a* and *2b*). The tapes 79 are also driven by the shaft 53.

In the embodiment of FIGS. *4a* and *4b*, sheets arriving from the conveyor tapes 4 (FIGS. *1a* and *1b*), which are driven by the shaft 22, are simultaneously laid laterally against the side lay edges 66 as well as against the leading-edge stops 80.

The table plate between the conveyor roller 19 and the feed rollers 52 and 7 is formed, for example, of plates, which are not illustrated in the interest of clarity, secured between the side frames 11 and 12; however, it may also be formed of rails located below the tapes 79 of the front lays 10 revolving in accordance with the printing-machine cycle.

Due to a slightly upward bend formed in the conveying plane between conveyor roller 19 and the front lays 10, as illustrated in FIGS. *2a* and *2b*, the stability of the sheet is increased during the aligning operation.

It is also conceivable to provide two axial cam disks, respectively, having two displacing lever configurations on each side of the control shaft 37.

Figure 8:
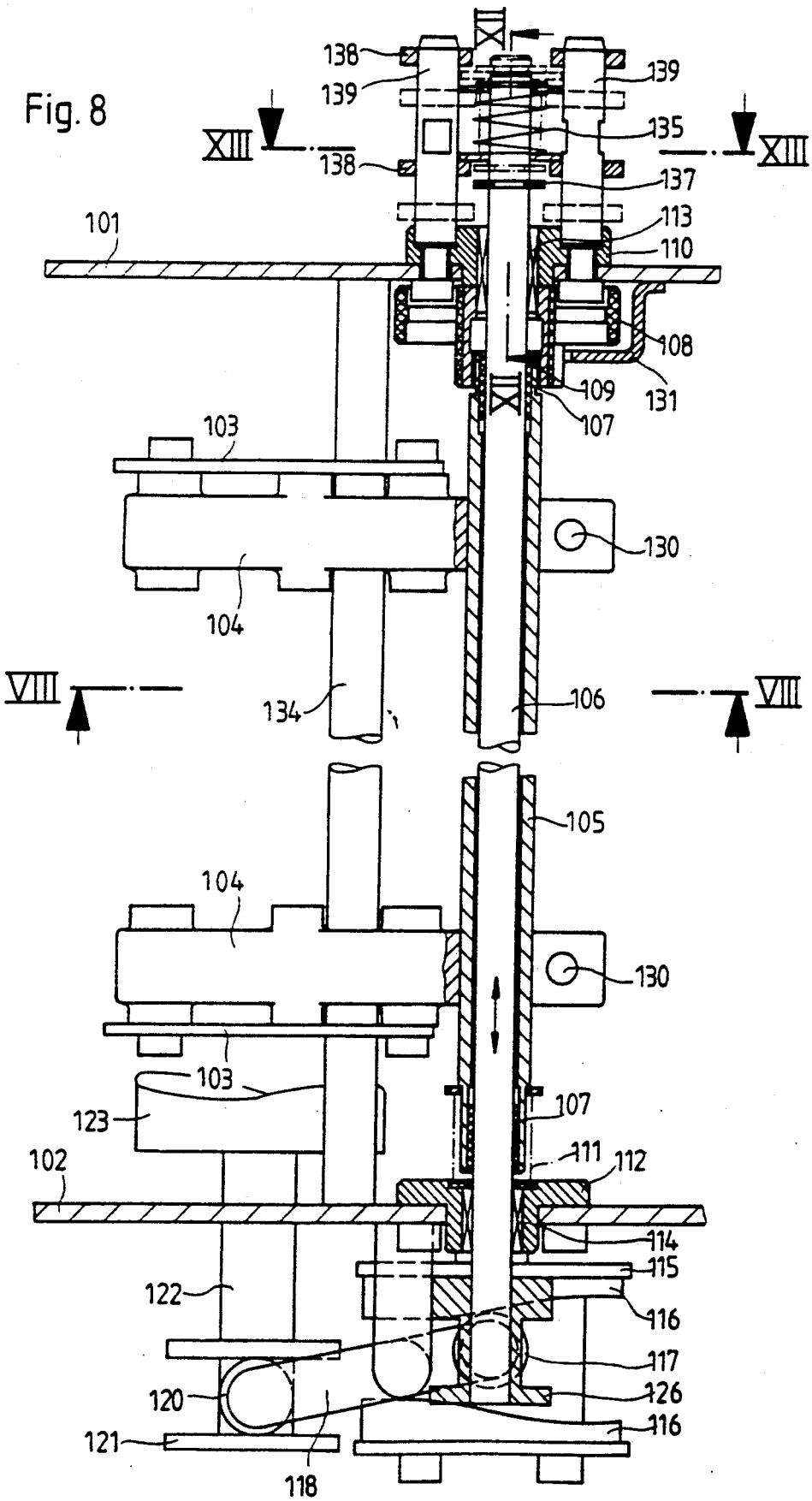
FIG. 8 is a fragmentary longitudinal sectional view of another embodiment of the device according to the invention.

In FIG. 8, two feed plates 103 for laterally aligning the sheets on the feed table are provided between the side frames 101 and 102. The feed plates 103 are fastened to holders 104 which, in turn, are clamped onto a tubular traverse 105. The tubular traverse 105 is mounted on an axially displaceable push rod 106 by means of a bearing 107 and is laterally adjustable via a handwheel 108 and a thread guide 109. The handwheel 108 is braced against a bearing body 110 which is fastened to the side frame 101. Counterpressure is generated by a compression spring 111 which is provided on the opposite side of the traverse 105, the compression spring 111 being braced against a bearing body 112 which is likewise fastened to a side frame 102. Thus, the feed plates 103 for the sheets to be printed are able to be precisely adjusted by the handwheel 108. Bearing bushings 113 and 114 which permit the axial movement of the push rod 106 are provided in the bearing bodies 110 and 112.

Figure 9:
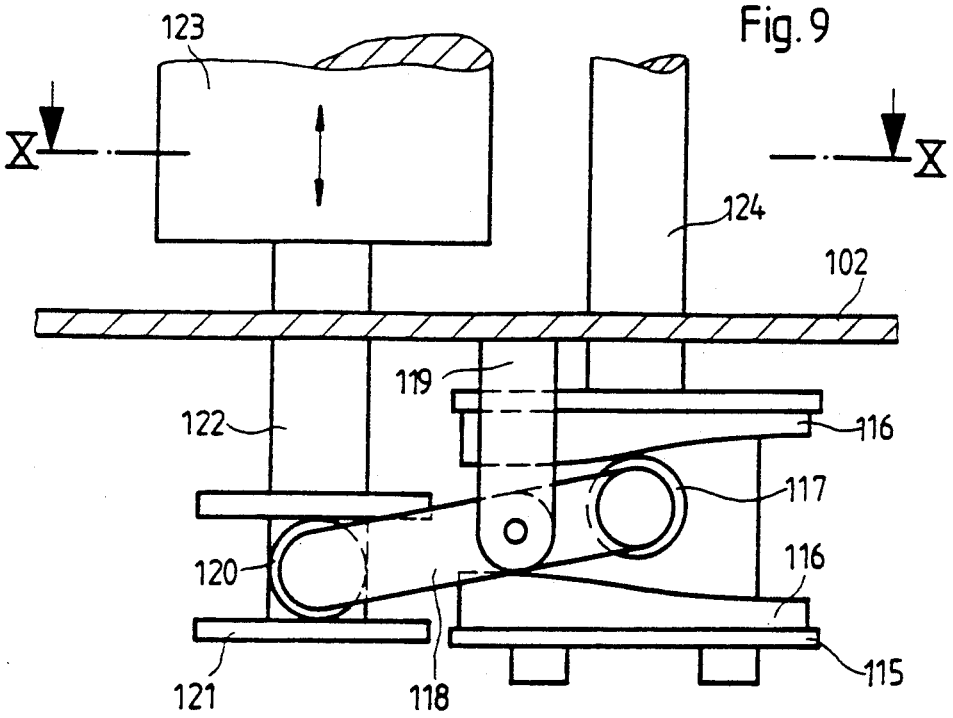
FIG. 9 is a slightly enlarged fragmentary view of FIG. 8 showing details of the control system of the invention.

A double control cam 115 having two radial cam disks 116 is secured on a drive shaft 124 (FIGS. 8 and 9). In the embodiment of the invention illustrated in FIGS. 8 and 9, a cam roller 117, on one side thereof, abuts a cam disk 116. The cam roller 117 is fastened to a double lever 118 which is tiltably mounted in a bearing body 119, the bearing body 119 being fastened to the side frame 102. At the opposite end of the double lever 118, there is provided a first control roller 120 which engages in a grooved disk 121. The grooved disk 121 is secured on a journal 122 of a conveyor roller 123 which is likewise mounted in the two side frames 101 and 102.

Figure 10:
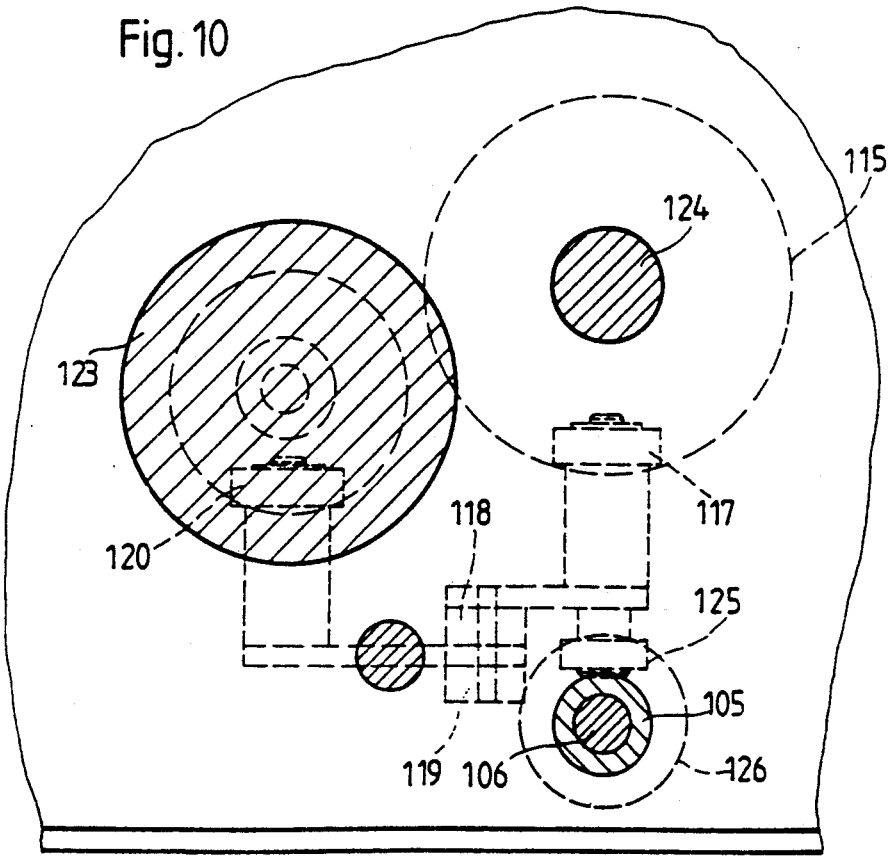
FIG. 10 is a fragmentary cross-sectional view of FIG. 9 taken along the line X—X in the direction of the arrows.

FIG. 10 shows the double lever 118 with the cam roller 117 engaging in the control cam 115. Opposite the cam roller 117, the double lever 118 is provided with a further control roller 125 engaging in a grooved disk 126 which, in turn, is secured on the push rod 106. When the drive shaft 124 imparts rotary motion to the control cam 115, the cam roller 117 transmits a pendular or swinging motion to the double lever 118. Due to this pendular motion, the control roller 125 drives the grooved disk 126 and causes the push rod 106 to execute an axial stroke movement. Simultaneously, the conveyor roller 123 is axially displaced in the opposite direction, via the first control roller 120, as indicated by the associated double-headed arrow in FIG. 9.

FIG. 11 shows the feeder device for single sheets 127 which are moved by the conveyor roller 123, in connection with a ball 128 supported thereon, in the direction of the arrow associated therewith and perpendicularly thereto up to the contact surfaces 129 of the feed planes 103. For laterally adjusting the feed plates 103, the holders therefor are releasably clamped onto the tubular traverse 105 by means of a tommy screw 130 or similar vise-like device. The range of adjustment in the handwheel 108 is limited by a stop 131. For this purpose, the handwheel 108 is provided with a trip dog 132, and the stop 131 is provided with a further trip dog 133, the trip dogs 132 and 133 colliding with one another during the rotary movement of the handwheels 108, and thereby preventing further rotation. In order to prevent the holders 104 of the feed plates 103 from being affected by the rotary motion, a guide rod 134 on which the holders 104 are braced is provided.

FIGS. 12 through 14 show the end of the push rod 106 located opposite the grooved disk 126; on the push rod 106, there is provided a compression spring 135 which, at both ends thereof, is limited in the extension thereof by disks 136 and retaining rings 137. An abutment or counter-bearing 138 surrounds the compression spring 135 in the longitudinal direction of the latter. The abutment 138 is guided on two sliding guides 139 and is axially displaceable by an eccentric pin 140 for converting the direction of application of the spring force. The eccentric pin 140 is fastened to a toggle grip or tommy 141 which is mounted in a bearing 142 provided on the side frame 102. The abutment 138 is formed with a recess 143 which extends around the push rod 106 and which is of such dimension that the disks 136 can come into contact with the one or the other side of the abutment 138. In the position of the abutment 138 shown in FIG. 12, the compression spring 135 is in a right-hand position so that, on its left-hand side, it is braced against the abutment 138 via one of the disks 136 and, on its right-hand side, it is braced against the retaining ring 137 via another of the disks 136. In this case, the compression spring 135 exerts a spring force against the push rod 106 directed towards the right-hand side. By pivoting the toggle grip or tommy 141 into the position indicated by the broken line in FIG. 14, the compression spring 135 is braced against the right-hand side of the abutment 138 and abuts the retaining ring 137 on the left-hand side via the disk 136. In this connection, the force of the compression spring 135 applied to the push rod 106 is directed towards the left-hand side (FIG. 12). As shown in FIG. 14, the eccentric pin 140 may be moved into a middle position (tommy 141 represented in phantom) in which no spring force acts upon the push rod 106.

Depending upon the direction in which the force of the compression spring 135 acts, the push rod 106 transmits a spring force to the double lever 118 via the grooved disk 126 and the control roller 125, so that the cam roller 117 located opposite the double lever 118 abuts one or the other cam disk 116. It is possible, thereby, to control the axial stroke movement of the conveyor roller 123 via the first control roller 120 and the grooved disk 121 so that the fed sheet abuts either the right-hand or the left-hand feed plate 103. If the rear side of a sheet is to be printed on, the pressman need only shift the tommy or vise-like device 121 into the other position thereof after the sheet pile has been turned and inserted into the sheet feeder, and the supplied sheets are caused to abut a feed plate 103 at the same side so that differences in the size of the sheets can have no detrimental effects.

We claim:

1. Device for conveying and aligning sheets on a feed table of a printing machine having a single-sheet feeder, an aligning section, and conveying means revolving on shafts for conveying the sheets in a direction across the aligning section to feed rollers for feeding the sheets to an impression cylinder, comprising bearings secured to side frames of the feed table so as to be cyclically adjustable in elevation, the shafts being rotatably mounted in said bearings and being cyclically displaceable laterally to the sheet-conveying direction, guide means secured in said side frames, a feed plate carried by said guide means above the feed table and being laterally adjustable with respect to the position thereof on said guide means, the conveying means including a revolving conveyor device disposed below said feed plate, said feed plate being formed with aligning edges disposed laterally forward of and behind said revolving conveyor device and constituting a lateral aligning limit, a lower edge of said feed plate extending contact-free over said revolving conveyor device.

2. Device according to claim 1, wherein said revolving conveyor device is movable between a raised and a lowered position thereof, and including balls freely rotatable in all directions and supported by their own weight on the revolving conveyor device in a raised position of the latter, guide bushings for receiving said balls therein so that said balls are movable substantially perpendicularly to the sheet-conveying direction, said guide bushings having retaining means for preventing said balls from falling through said guide bushings in said lowered position of said revolving conveyor device.

3. Device according to claim 1, wherein said revolving conveyor device is formed of at least one conveyor roller of substantially uniform diameter firmly mounted on one of the shafts, and including drive means for driving said one shaft.

4. Device according to claim 1, including respective levers secured to outer sides of said side frames so as to be pivotable about a pivot axis on the respective side frames, said side frames being formed with openings through which the shafts of the conveying means project freely movably outwardly, said bearings wherein said shafts are rotatably and displaceably mounted being coaxially secured to said levers, and means for reciprocatingly pivoting said levers upwardly and downwardly in accordance with the printing-machine cycle.

5. Device according to claim 3, including respective levers secured to outer sides of said side frames so as to be pivotable about a pivot axis on the respective side frames, said side frames being formed with openings through which the one shaft of a plurality of the conveyor rollers projects freely movably outwardly, said bearings wherein said shaft is rotatably and displaceably mounted being coaxially secured to said levers, means for reciprocatingly pivoting said levers upwardly and downwardly in accordance with the printing-machine cycle, said one shaft having at least one extension projecting outwardly through a respective bearing at one of said levers, said drive means for driving said one shaft and said conveyor rollers, and means for laterally displacing said one shaft and said conveyor rollers being operatively connected to said projecting extension.

6. Device according to claim 5, wherein said projecting extension of said one shaft is formed with a circumferential guidance groove with which a guide roller is in constant sliding contact, said guide roller having a rotational plane extending parallel to the axis of said one shaft, and including an axial displacement lever having two lever arms and being pivotally mounted on a lateral mounting support located at the outer side of the respective side frame through which said shaft extension projects, said guide roller being rotatably mounted on one of said lever arms of said axial displacement lever, a control shaft supported in said side frames, an axial cam disk coaxially secured to an end of said extension projecting beyond the respective side frame, a sensing roller in constant contact with said axial cam disk along a cam contour of said axial cam disk, said sensing roller being rotatably mounted on the other of said lever arms of said axial displacement lever.

7. Device according to claim 6, including a gearwheel firmly seated on said projecting extension of said one shaft, a drive shaft coaxial with said pivot axis extending in the form of a journal at both ends thereof through said side frames and being rotatably supported in said side frames of said feed table, said levers being freely rotatably mounted in axially fixed position, gearwheels securely mounted on said journals outside said levers, one of said levers having a pin whereon a gearwheel broader than said gearwheel seated on said extension of said one shaft is freely rotatably mounted yet fixed against axial movement, said broader gearwheel being in meshing engagement with said gearwheel on said extension and with a respective one of said gearwheels mounted on one of said journals, said control shaft having an extension projecting outwardly through the respective side frame located opposite said axial cam disk, a gearwheel secured on said last-mentioned control shaft extension, a gear train disposed between one of said gearwheels mounted on said journals outside of said levers and said gearwheel secured on said control shaft extension, a radial sensing roller having an axis of rotation extending parallel to said control shaft being freely rotatably mounted on an end of one of said two levers located opposite to a respective pivot axis extending through one of the respective bearings, and a radial cam disk corresponding to said radial sensing roller and in addition to said axial cam disk being located on the same side of the feed table and coaxially secured to said control shaft outside the respective side frame of the feed table, said radial cam disk being in constant contact with said radial sensing roller.

8. Device according to claim 7, wherein said axial cam disk and said radial cam disk are secured to the same extension of said control shaft.

9. Device according to claim 1, wherein said lower edge of said feed plate, directly forward of and behind said revolving conveying device is formed with downwardly directed extension as lay edges which are free from contact with said revolving conveying device.

10. Device according to claim 1, including front lays rotatably guided over the region of said revolving conveying device, said front lays having a rear reversal point in vicinity of said feed rollers, and being operatively connected with a drive shaft at a respective reversal point, and a gear train extending from said drive shaft to a printing unit of the printing machine.

11. Device according to claim 1, including drive means for said shafts, means for laterally displacing said shafts in said bearings and lifting means for raising and lowering said bearings, respectively, said drive means, said lateral displacement means and said lifting means having a common gear train extending to a printing unit of the printing machine.

12. Device according to claim 1, including another feed plate located at the other side of the sheets fed thereto for alternatingly aligning the sheets, said revolving conveyor device comprising a conveyor roller for moving the sheets towards said feed plates, and a double control cam for axially displaceably driving said conveyor roller so as to bring the sheets into lateral contact alternatively with one of said feed plates.

13. Device according to claim 12, including a cam roller assigned to said double control cam for transmitting, via a double lever, a first control roller and a grooved disk, a stroke movement to a journal of said conveyor roller, a compression spring for transmitting spring force via a push rod carrying another grooved disk to a second control roller, said second control roller pressing said cam roller against one of said cam disks of said double control cam via said double lever, and a counterbearing via which the direction of the force of said compression spring is reversible with respect to the direction of application thereof.

14. Device according to claim 13, wherein said compression spring is mounted on said push rod and has a respective retaining ring for limiting the extension thereof on both sides thereof, said compression spring being surrounded by said counterbearing in longitudinal direction of said spring, said counterbearing being guided on sliding guides and being axially displaceable for converting the lateral abutment of the sheets against said feed plates by means of an eccentric pin so that one alternative side of said compression spring is braced against said counterbearing, and the other side thereof is braced against a retaining ring and so that the force acts in one alternate direction.

15. Device according to claim 13, including a common tubular traverse whereon said feed plates disposed on both sides of the sheets are secured, said tubular traverse being mounted on said push rod, and a handwheel with a threaded guide for laterally adjusting said tubular traverse.

* * * * *